US005964086A

United States Patent [19]

Kraemer

[11] Patent Number: 5,964,086

[45] **Date of Patent: *Oct. 12, 1999**

[54] FLASHBACK SYSTEM

[75] Inventor: Gilbert O. Kraemer, New Haven, Conn.

[73] Assignee: Precision Combustion, Inc., New Haven, Conn.

[ * ] Notice: This patent is subject to a terminal disclaimer.

[21] Appl. No.: 08/819,425

[22] Filed: Mar. 17, 1997

Related U.S. Application Data

[63] Continuation-in-part of application No. 08/485,853, Jun. 7, 1995, Pat. No. 5,628,181.

[51] Int. Cl.[6] ..... F02G 3/00

[52] U.S. Cl. ..... 60/39.06; 60/39.11; 60/723

[58] Field of Search ..... 60/39.06, 39.11, 60/723, 737, 753

[56] References Cited

U.S. PATENT DOCUMENTS

| | | | |
|---|---|---|---|
| 2,532,709 | 12/1950 | Goddard | 60/39.11 |
| 2,551,115 | 5/1951 | Goddard | 60/39.11 |
| 5,003,768 | 4/1991 | Kappler et al. | 60/723 |
| 5,628,181 | 5/1997 | Kraemer | 60/39.11 |

*Primary Examiner*—Charles G. Freay
*Attorney, Agent, or Firm*—Kane, Dalsimer, Sullivan et al.

[57] ABSTRACT

Flashback of flames in premixed combustion systems is avoided by passing premixed fuel and air prior to combustion through a series of two or more nonaligned multichannel monolith attached in series. The device is useful as a pre-ignition inhibitor, a detonation wave inhibitor and a flashback arrestor protector.

8 Claims, 1 Drawing Sheet

FLASHBACK SYSTEM

CROSS-REFERENCE TO RELATED APPLICATION

This application is a Continuation-In-Part of my U.S. patent application Ser. No. 08/485,853 filed Jun. 7, 1995 now issued as U.S. Pat. No. 5,628,181.

FIELD OF THE INVENTION

The invention relates to a non-flashback apparatus to avoid stoichiometric combustion of fuel prior to mixing with sufficient air to achieve lean mixtures for combustion.

BACKGROUND OF THE INVENTION

In conventional gas turbine combustors liquid or gaseous fuel is sprayed directly into the combustion chamber for combustion in admixture with air. Consequently, fuel-air mixing and vaporization occur in the combustion zone resulting in significant regions of stoichiometric combustion and high $NO_X$ formation.

Accordingly, to achieve lower $NO_X$ levels there has been interest in and much development of premixed/prevaporized fuel combustion systems such as the dry low $NO_X$ natural gas combustors now used commercially. However, such combustors not only can have stability problems stemming from the need to operate near the lean limit but as with any premixed/prevaporized combustion system there is the potential for propagation of the flame upstream to the mixing/vaporization region with resultant stoichiometric burning and damage to the combustor. Although a safety shut-off can minimize damage, a shut down and inspection would be essential. With liquid fuels the problem is even greater. Moreover, the high combustor inlet temperatures not only of advanced stationary and aero gas turbine designs but even of most present day aero engines greatly increase the likelihood of such an occurrence. The problem is so severe that it has been questionable as to whether any premixed combustor will ever be feasible for an aero engine inasmuch as no conventional device has been deemed adequate to avoid engine damage. Not only must a device be able to block upstream flame propagation but it must impose a negligible pressure drop, i.e., less than about one percent. The present invention offers a practical low pressure drop solution to this important problem. Conventional flame arrestors installed on an exhaust have limited life and durability. Many of the flashback arrestor designs manufactured today support flame holding off the flashback arrestor after quenching a flashback event over some reducing agent/oxidizing agent ratio, inlet temperature and inlet velocity. Flame holding off the flashback arrestor can lead to thermal distress of the downstream structures, flashback arrestor. Over some period of time the held flame can ignite the upstream reducer/oxidizer mixture, usually resulting in failure of at least the flashback arrestor. The art teaches of supplying an external coolant to prevent damage to the flashback arrestor if a flame should hold off it.

The present invention is an improvement in flame arresting in that it will reduce the turbulence enough to prevent flame holding off the flashback arrestor at inlet velocities slightly higher than the turbulent flame speed. The turbulent flame speed can be defined as the sum of the laminar flame speed and the r.m.s. turbulent velocity. We have demonstrated a two monolith off-set flashback arrestor design which prevented flame holding off the face after flashback at inlet velocities similar to the estimated laminar flame speed.

The present invention provides a device that will reduce the quenching length usually required to quench flashback for a given cell geometry and width. Typically, a single channel monolith requires only 40 diameters to quench a flame.

The minimum channel diameter may be increased above the quenching diameter which allows more open, less expensive structures.

SUMMARY OF THE INVENTION

It has now been found that offset monoliths offer a very low pressure drop yet very effective barrier to flame propagation. This can be useful to inhibit pre-ignition, detonation wave propagation and to arrest flashback. In the present invention atomized fuel premixed with the combustion air is passed through an assembly of two or more monoliths in series prior to entering a fuel lean combustion zone. The monoliths assembled together in series, are preferably spaced no more than five millimeters apart and at least one of the monoliths has channels of less than about three millimeters in diameter. Mounting of the monoliths in series with channels offset is advantageous. With monolith assemblies of the present invention, combustion does not propagate upstream of the monoliths and stoichiometric upstream combustion is avoided. In the present invention it is believed that offset monoliths are unexpectedly effective because a flame kernel passing through the center of a monolith is quenched on encountering a wall of an adjoining monolith. Downstream pre-ignition is inhibited as a result of a reduction in turbulence after the flame arrester.

Pre-ignition can occur after the introduction of fuel and before the desired flame holding location especially in hot, low velocity, turbulent region of the channel. A flame kernel can form a flame and spread rapidly if not extinguished. Maintaining the local turbulent flame speed below the local velocity can allow the flame kernel to be quenched, if the bulk inlet temperature is not too high (1800 to 2100 F). Where the turbulent flame speed can be defined as the sum of the laminar flame speed and the r.m.s. turbulent velocity, the present invention can be configured to reduce the upstream turbulence dramatically [a reasonable goal for many gas turbines of less than 10% turbulence intensity]. The present invention can arrest flashback without reducing the upstream turbulence to inhibit flashback.

The reduction in turbulence experienced with the use of the invention also inhibits the propagation of detonation waves. The channel length in a conventional monolith encourages through its length the formation of a detonation wave (sonic). In the preferred device of the invention, a deflagration wave is formed instead. A deflagration wave will produce less damage within a reactor than a detonation wave. Reducing the flow stream turbulence will usually require a longer channel length for the combustion wave's turbulence level to rise to a value required for detonation to occur. As a flame arrestor, the device of the present invention can reduce the flow stream turbulence, permitting a longer channel length or different channel geometry or both safely.

DETAILED DESCRIPTION OF THE INVENTION AND PREFERRED EMBODIMENTS

Figure 1:
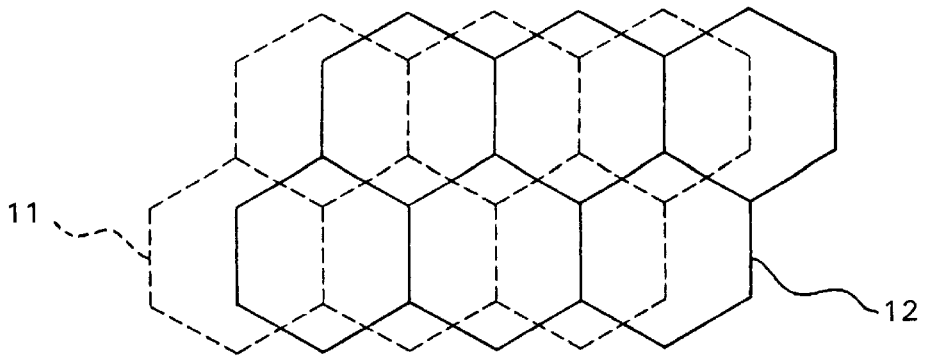
FIG. 1 shows an end view of a two element hexagonal cell monolith apparatus of the present invention showing a downstream monolith with channels offset from the channels of the upstream monolith.

As shown in FIG. 1, monoliths 11 and 12 are mounted together in assembly such that the channels are not aligned. Downstream monolith 11 is mounted such that its channel walls intercept the flow from upstream monolith 12. Although both monoliths as shown have the same cell size, the downstream monolith advantageously may have larger or smaller cells to reduce pressure drop. Advantageously, at least one monolith comprises walls spaced apart less than about three millimeters, preferably less than two millimeters. When the channel lengths are between about 1 to 3 mm in length, it is also advantageous that the channel diameters have a diameter ratio to length of about 0.5 to 2.0:1.0.

Figure 2:
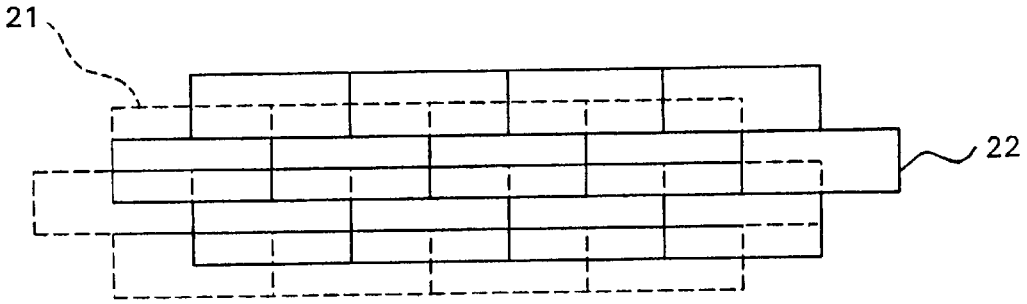
FIG. 2 shows an end view of a two element rectangular cell monolith assembly of the present invention with the downstream monolith channel walls intersecting the center channel flow from an upstream monolith.

In FIG. 2, rectangular cell monoliths 21 and 22 are similarly offset mounted. Downstream monolith 21 is mounted such that its channel walls intercept the flow from the channels of upstream monolith 22. Thus, flame propagating upstream through the downstream monolith is first partially quenched by wall contact.

Figure 3:
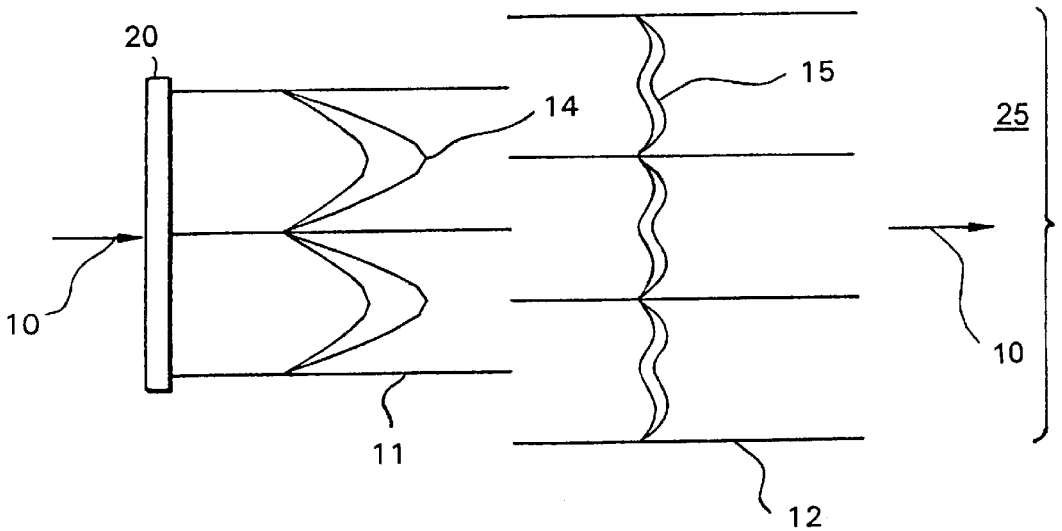
FIG. 3 shows a schematic axial cross-sectional view portraying the quenching effect of an offset upstream monolith on a flame front propagating upstream through a downstream monolith.

As shown in FIG. 3 a fuel/air mixture 10 passes through mixer 20 prior to entering monolith 11. Fuel/air mixture 10 upon exiting monolith 12 then enters combustion region 25. The figure further shows fluid flows 14 and 15 traveling through monoliths 11 and 12, respectively. During a flashback, a flame kernel would be traveling in the opposite direction through monoliths 12 and 11. A flame kernel escaping through a monolith channel central core are intercepted and quenched by contact with the walls of the misaligned upstream monolith. In addition, as shown in FIG. 3, for maximum effectiveness the nonaligned monoliths should be close coupled to avoid flame spread between monoliths.

To test for flashback protection effectiveness, combustion was established downstream of a monolith assembly and flow velocity then decreased to below the flame flashback velocity. With only one 1.58 mm long monolith with 0.79 mm diameter cells the flame flashed back through the monolith. With three 6.35 mm long monoliths having 3.17 mm diameter cells flame also flashed back. However, with one 6.35 mm long monolith of 3.17 mm cells followed by one 1.58 mm long monolith of 0.79 mm diameter cells flashback was prevented. Thus one 0.79 mm diameter cell monolith could not prevent flashback through the monolith but with the addition of an upstream large cell monolith could.

We claim:

1. An assembly to prevent propagation of combustion comprising; a first and a second multi-channel monolith assembled together in series; with the channels of said second monolith nonaligned with the channels of the first monoliths, and said channels having a quenching length.

2. The assembly of claim 1 in which at least one of said first and second monoliths has a channel wall spacing of less than three millimeter.

3. The assembly of claim 2 in which the downstream monolith is shorter than the upstream monolith.

4. The assembly of claim 1 comprising monoliths fabricated of metal.

5. The assembly of claim 1 comprising monolith fabricated of ceramic.

6. The method of avoiding flame flashback and inhibiting pre-ignition in premixed combustion systems comprising; mixing fuel and air in a mixing zone; burning said mixed fuel and air in a combustion zone; and passing a mixture of fuel and air to combustion through an assembly of two or more multi-channel monoliths, the channels of at least two of said monoliths being nonaligned, said channels having quenching length.

7. The method of claim 6 wherein at least one of said monoliths has channels with walls spaced less than three millimeters apart.

8. A method of inhibiting propagation of a detonation wave in a combustion system, which comprises a first zone of pre-mixed fuel and air and a following second zone of combustion, which comprises; inserting in the system between first and second zones, an assembly comprising a first and a second multi-channel monolith, the channels of said first monolith being mis-aligned with the channels of said second monolith and said channels having a quenching length.

* * * * *

UNITED STATES PATENT AND TRADEMARK OFFICE

CERTIFICATE OF CORRECTION

PATENT NO. : 5,964,086
DATED : October 12, 1999
INVENTOR(S) : Gilbert O. Kraemer It is certified that error appears in the above-identified patent and that said Letters Patent is hereby corrected as shown below:

Col. 4, line 30, after "having"
insert --a--.

Signed and Sealed this

Eighteenth Day of April, 2000

*Attest:*

Q. TODD DICKINSON

*Attesting Officer*

*Director of Patents and Trademarks*